US008077003B2

(12) United States Patent
Ikezawa

(10) Patent No.: US 8,077,003 B2
(45) Date of Patent: Dec. 13, 2011

(54) COIL COMPONENT, TRANSFORMER AND SWITCHING POWER SUPPLY UNIT

(75) Inventor: Akira Ikezawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/723,226

(22) Filed: Mar. 12, 2010

(65) Prior Publication Data

US 2010/0237971 A1 Sep. 23, 2010

(30) Foreign Application Priority Data

Mar. 19, 2009 (JP) ..... P2009-068193

(51) Int. Cl.
*H01F 27/28* (2006.01)
*H01F 27/08* (2006.01)

(52) U.S. Cl. ..... 336/61; 336/179; 336/180; 336/184; 336/220; 336/221; 336/222; 336/223

(58) Field of Classification Search ..... 336/61, 336/65, 184, 107, 178, 192, 220–223, 232
See application file for complete search history.

(56) References Cited

U.S. PATENT DOCUMENTS

| | | | | |
|---|---|---|---|---|
| 7,511,599 | B2 * | 3/2009 | Ye et al. | 336/200 |
| 7,911,309 | B2 * | 3/2011 | Tsai et al. | 336/200 |
| 2007/0171023 | A1 * | 7/2007 | Ikezawa | 336/208 |
| 2008/0239759 | A1 * | 10/2008 | Nakahori | 363/20 |
| 2008/0266042 | A1 | 10/2008 | Yoshimura et al. | |
| 2009/0108971 | A1 * | 4/2009 | Okamoto | 336/65 |
| 2009/0144967 | A1 * | 6/2009 | Hasu et al. | 29/605 |

FOREIGN PATENT DOCUMENTS

| | | |
|---|---|---|
| JP | U-2-4217 | 1/1990 |
| JP | A-06-325959 | 11/1994 |
| JP | A-2000-348951 | 12/2000 |
| JP | A-2002-281758 | 9/2002 |
| JP | A-2003-272934 | 9/2003 |
| JP | A-2008-253113 | 10/2008 |
| JP | A-2008-277485 | 11/2008 |
| WO | WO 2006/016554 A1 | 2/2006 |

* cited by examiner

*Primary Examiner* — Anh Mai
*Assistant Examiner* — Mangtin Lian
(74) *Attorney, Agent, or Firm* — Oliff & Berridge, PLC

(57) ABSTRACT

A coil component includes a first coil winding wound around a first axis, a second coil winding wound around a second axis and juxtaposed to the first coil winding, a connecting member for electrically connecting second terminals that are one end of the first coil winding and one end of the second coil winding, and a heat conductive member mounted on the connecting member and having electrical insulation properties and heat conductivity. The first and second coil windings are each wound such that magnetic flux is generated by a current flowing through the first and second coil windings to pass through an opening of the first coil winding and through an opening of the second coil winding in an opposite direction to the direction passing the opening of the first coil winding. Accordingly, heat generated in the first and second coil windings is dissipated from the heat conductive member.

5 Claims, 10 Drawing Sheets

COIL COMPONENT, TRANSFORMER AND SWITCHING POWER SUPPLY UNIT

BACKGROUND OF THE INVENTION

1. Field of the Invention

The present invention relates to a coil component, a transformer, and a switching power supply unit.

2. Related Background Art

As a component installed in an automobile, there is known a switching power supply unit such as a DC-DC converter for converting a high voltage to a low voltage or converting a low voltage to a high voltage. As one of the coil components used for a switching power supply unit, there is one known as disclosed in Japanese Utility Model Publication No. JP-U-H2-004217. The coil component disclosed in JP-U-H2-004217 is structured to have two pieces of magnetic core legs (leg portions) and two pieces of magnetic core bases with windings wound around each of the leg portions such that magnetic flux that passes through both of the leg portions and the bases in one direction in a loop is formed.

SUMMARY OF THE INVENTION

However, when the coil component disclosed in JP-U-H2-004217 is applied to, for example, a choke coil in a switching power supply unit, a large amount of current flows through a coil constituting the coil component, whereby a large amount of heat is generated from the coil. The heat generated may cause degradation of the coil itself or deterioration in function of devices disposed in periphery of the coil component, for example.

In view of the problems described above, an object of the present invention is to provide a coil component, a transformer, and a switching power supply unit of enhanced heat dissipation of the heat generated in coil windings.

According to a first aspect of the present invention, a coil component includes: a first coil winding wound around a first axis and having a portion defining an opening in center thereof; a second coil winding wound around a second axis running along the first axis, juxtaposed to the first coil winding, and having a portion defining an opening in center thereof; a connecting member configured to electrically connect one end of the first coil winding and one end of the second coil winding together; and a heat conductive member having electrical insulation properties and provided to contact the connecting member, in which the first coil winding and the second coil winding are each wound such that magnetic flux is generated by a current flowing through the first coil winding and the second coil winding to pass through the opening of the first coil winding in one direction and through the opening of the second coil winding in an opposite direction to the direction passing through the opening of the first coil winding.

With the coil component, since the connecting member for electrically connecting the ends of the first coil winding and the second coil winding together is further coupled with the heat conductive member having electrical insulation properties, the heat generated in the first and second coil windings can be dissipated through the heat conductive member, which further enhances heat dissipation of the heat generated in the first and second coil windings.

In the coil component, the connecting member may connect together the ends of the first coil winding and the second coil winding disposed in the same direction along extending directions of the first axis and the second axis with respect to the first coil winding and the second coil winding.

The first coil winding and the second coil winding may be composed of members of the same form.

In this case, as the members of the same form can be used for the first and second coil windings, the steps to manufacture each of the coil windings individually can be omitted, thereby reducing the amount of work to manufacture the coil windings.

The first coil winding and the second coil winding each may be composed by joining a plurality of plate-like coil members in a ring shape having ends. Accordingly, when each of the first coil winding and the second coil winding is formed by joining the plate-like coil members together, the current flowing through these coil windings becomes extremely large. By installing the heat conductive member so as to dissipate heat, the deterioration in function of the coil component or the like can be avoided more adequately.

The coil component may further include a pair of magnetic core members sandwiching the first coil winding and the second coil winding. The heat dissipation effect by the heat conductive member is effectively used for the structure of the first coil winding and the second coil winding being sandwiched by the pair of magnetic core members.

According to a second aspect of the present invention, a transformer includes any of the coil components described above. In this case, a transformer using the coil component of enhanced heat dissipation from the coil windings can be obtained.

According to a third aspect of the present invention, a switching power supply unit includes any of the coil components described above. In this case, a switching power supply unit using the coil component of enhanced heat dissipation from the coil windings can be obtained.

In the switching power supply unit, the connecting member may be coupled with a chassis of the switching power supply unit via the heat conductive member contacting therewith.

As described above, since the heat conductive member is in contact with the chassis of the switching power supply unit, the connecting member is coupled with the chassis with the heat conductive member interposed therebetween. For example, when the chassis of the switching power supply unit serves as a part of a heat sink, the heat generated in the coil windings can be dissipated more effectively through the heat conductive member to the chassis, which further enhances the dissipation of the heat generated in the coil windings.

According to the present invention, a coil component, a transformer, and a switching power supply unit of enhanced heat dissipation of the heat generated in coil windings can be provided.

BRIEF DESCRIPTION OF THE DRAWINGS

The invention will be described with reference to the accompanying drawings, wherein like numbers reference like elements.

DESCRIPTION OF THE PREFERRED EMBODIMENTS

Embodiments of the present invention will now be described in details with reference to accompanying drawings, wherein like numbers reference like elements and their redundant descriptions are omitted.

Figure 1:
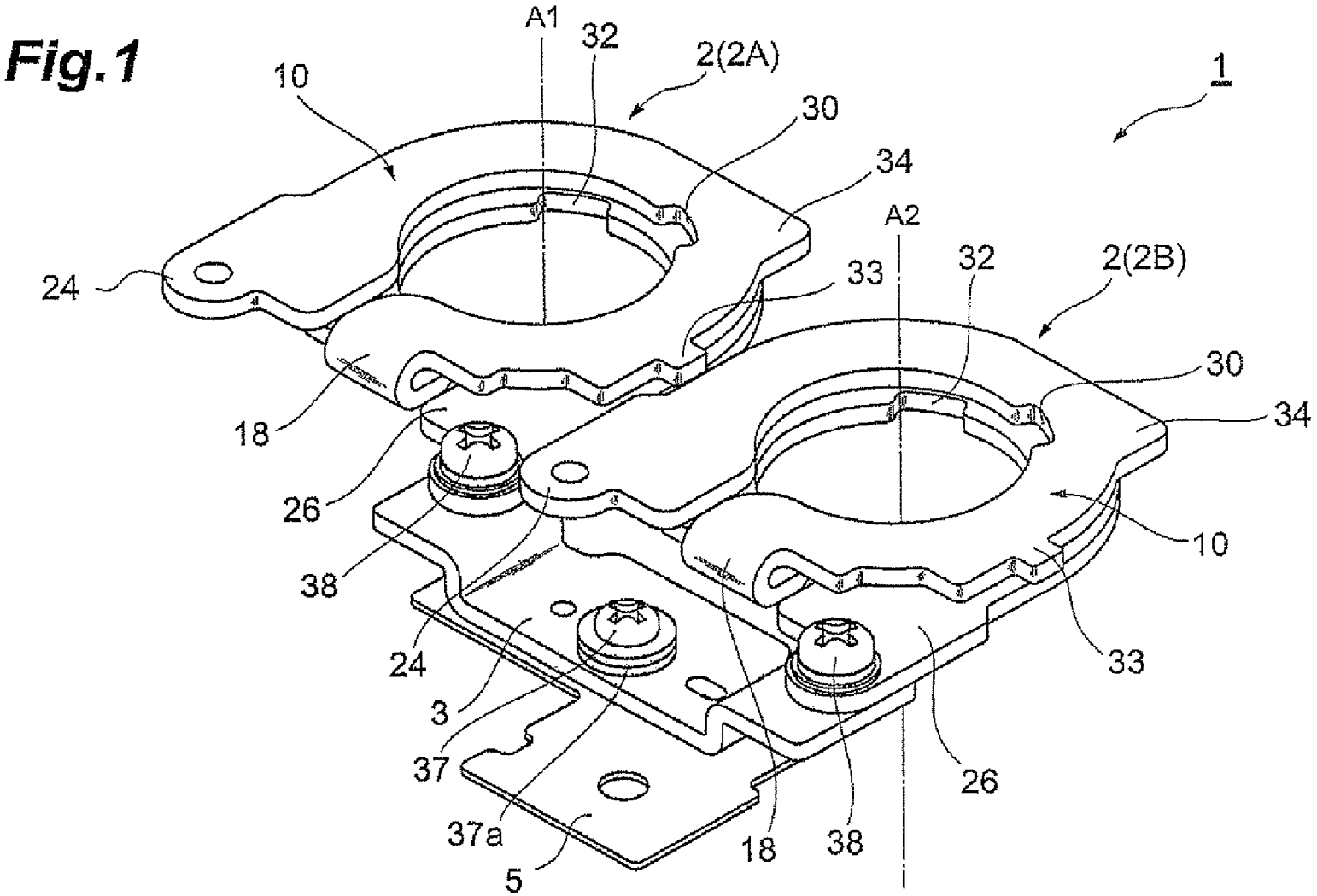
FIG. 1 is a perspective view of a coil component according to an embodiment of the present invention.
Figure 2A:
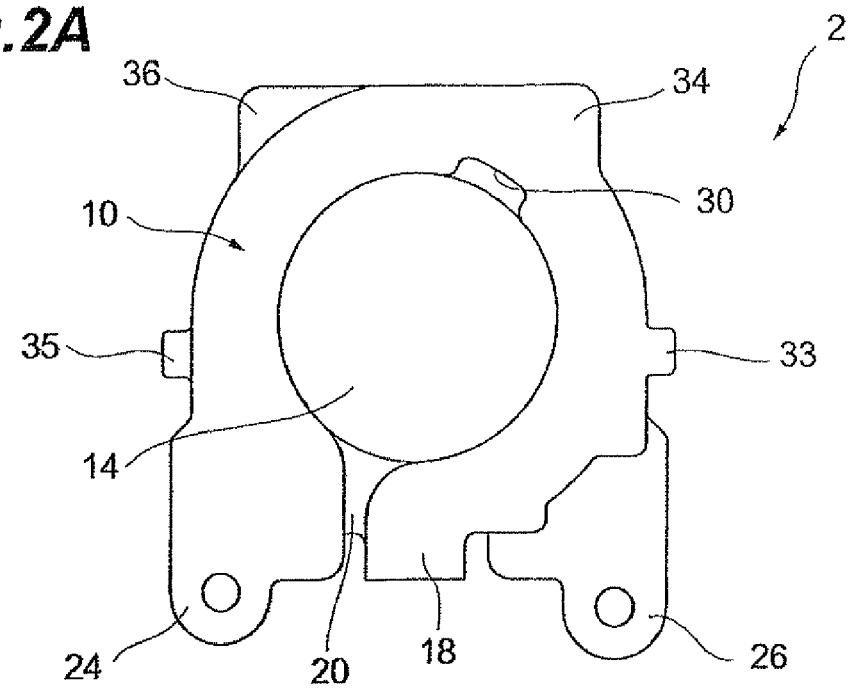
FIG. 2A is a plan view of a coil winding included in the coil component shown in FIG. 1.
Figure 2B:
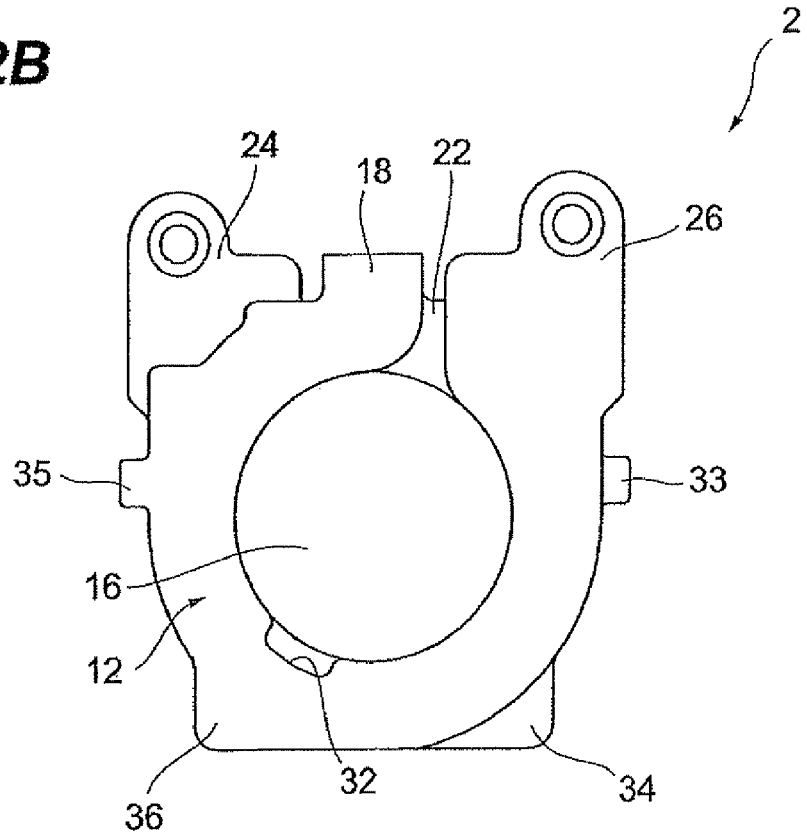
FIG. 2B is a bottom view of the coil winding.
Figure 3:
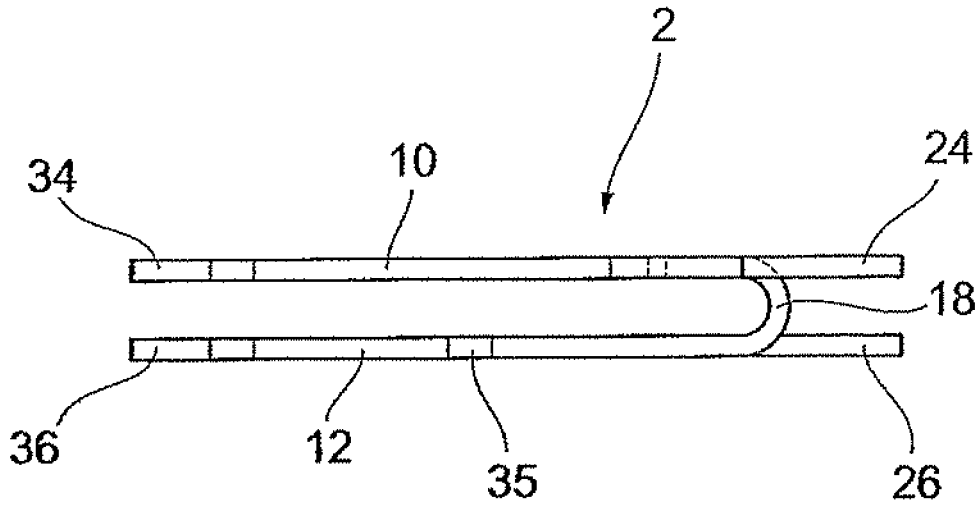
FIG. 3 is a side view of the coil winding.

With reference to FIGS. 1 to 3, the structure of a coil component according to an embodiment of the present invention will be described first. FIG. 1 is a perspective view of the coil component according to the present embodiment. FIG. 2A is a plan view of a coil winding constituting the coil component, and FIG. 2B is a bottom view of the coil winding. FIG. 3 is a side view of the coil winding.

A coil component 1 shown in FIG. 1 is the one used for an inductance element, a switching power supply unit such as a converter and an inverter, a noise filter, and the like. The coil component 1 is structured to include two pieces of coil windings 2 (first coil winding 2A and second coil winding 2B) composed of conductive plates, a connecting member (connecting bus bar) 3 for electrically connecting these two pieces of the coil windings 2 (2A and 2B) in series, and a heat conductive member (heat dissipation member) 5 having electrical insulation properties and being coupled with the connecting member 3.

In the coil component 1 according to the present embodiment, the first coil winding 2A and the second coil winding 2B are composed of the coil windings 2 that have the same form. The coil winding 2 is, as shown in FIGS. 1 to 3, composed of a first coil member 10 and a second coil member 12 in a ring shape having ends and of plate-like form being juxtaposed to each other with a clearance therebetween and joined together so as to be continuous in a predetermined winding direction.

The first and second coil members 10 and 12 in a ring shape having ends appear as referred to as C-shaped, and have circular openings 14 and 16, respectively, in the center thereof. Between one end and the other end of the first and second coil members 10 and 12, there are slits 20 and 22, respectively, extending from inner circumference to outer circumference thereof. The first coil member 10 and the second coil member 12 are coaxially arranged overlapping with each other such that the openings 14 and 16 are in communication with each other. The first coil member 10 and the second coil member 12 are overlapped such that the positions of the slit 20 and the slit 22 are not aligned (in other words, being not in communication with each other). Accordingly, the other end of the first coil member 10 overlaps with one end of the second coil member 12. Furthermore, the shape of the first and second coil members 10 and 12 is not limited to the shape of a ring having ends appearing as a letter C as described above and, for example, it may take on other shapes such as an oval or a rectangle.

On one end of the first coil member 10, a first terminal (electrical connection terminal) 24 is integrally provided outwardly protruding with respect to the center axis of the opening 14. The other end of the first coil member 10 is joined to one end of the second coil member 12 via a U-shaped joining portion 18. On the other end of the second coil member 12, a second terminal 26 is integrally provided outwardly protruding with respect to the center axis of the opening 16.

On the inner perimeter edge of the first coil member 10, a cutout portion 30 where a portion of the first coil member 10 is outwardly cut out is formed. Further, in the area of the outer perimeter edge of the first coil member 10 that is an extension of the line connecting the center axis of the opening 14 and the cutout portion 30, a protrusion 34 where a portion of the first coil member 10 is outwardly bulged is provided such that the outer perimeter edge of the first coil member 10 becomes larger in a radial direction.

Meanwhile, on the inner perimeter edge of the second coil member 12, a cutout portion 32 where a portion of the second coil member 12 is outwardly cut out is formed. Further, in the area of the outer perimeter edge of the second coil member 12 that is an extension of the line connecting the center axis of the opening 16 and the cutout portion 32, a protrusion 36 where a portion of the second coil member 12 is outwardly bulged is provided such that the outer perimeter edge of the second coil member 12 becomes larger in a radial direction.

The cutout portions 30 and 32 are pierced through the first and second coil members 10 and 12, respectively, in a thickness direction thereof. When viewed from directions of the center axes of the openings 14 and 16, the cutout portions 30 and 32 have a predetermined width along the circumferences of the openings 14 and 16, respectively, and have a predetermined depth in radial directions of the openings 14 and 16, respectively. The cutout portion 30 provided to the first coil member 10 and the cutout portion 32 provided to the second coil member 12 are, when viewed from the directions of the center axes of the openings 14 and 16, provided at the positions different from each other. The protrusion 34 provided to the first coil member 10 and the protrusion 36 provided to the second coil member 12 have a predetermined width along the outer perimeter edges of the first and second coil members 10 and 12, respectively, and are provided such that the respective outer perimeter edges outwardly protrude by a predetermined amount.

The protrusions 34 and 36 are provided at the respective outer perimeter edges that are extensions of the lines connecting the center axes of the openings 14 and 16 to the cutout portions 30 and 32, respectively. Consequently, the widths of the first and second coil members 10 and 12 (width of the conductive plate) in the areas where the respective cutout portions 30 and 32 are formed are ensured, thereby preventing the widths of the first and second coil members 10 and 12 in the peripheries of the respective cutout portions 30 and 32 from being narrow and preventing their respective electrical resistances that cause heat or the like from increasing. In the present embodiment, as described above, the protrusions 34 and 36 are provided to ensure the widths of the first and second coil members 10 and 12 in the areas where the cutout portions 30 and 32 are formed, respectively, thereby preventing an electrical resistance from increasing due to the reduction in the cross-sectional areas of the first and second coil members 10 and 12, which are determined by the width and thickness of the conductive plate. The protrusions 34 and 36 are, when viewed from the directions of the center axes of the openings 14 and 16, provided at positions different from each other.

The first and second coil members 10 and 12 are further provided with protrusions 33 and 35 that are different from the protrusions 34 and 36, respectively. The protrusion 33 is provided to the outer circumference of the first coil member 10 at a position different from the protrusion 34 (for example, as shown in FIG. 2A, at a position 90 degrees to the joining portion 18 with an axis of winding of the coil winding 2 as a reference). The protrusion 35 is provided to the outer circumference of the second coil member 12 at a position different from the protrusion 36 (for example, as shown in FIG. 2B, at a position −90 degrees to the joining portion 18 with the axis of winding of the coil winding 2 as a reference). As illustrated above, the first and second coil members 10 and 12 may be provided with a plurality of protrusions.

The coil winding 2 structured as above can be formed by punching a single plate of a high electrical conductivity. More specifically, from a plate of copper, aluminum, or the like, the first terminal 24, the first coil n ember 10 continuing from the first terminal 24, the second coil member 12, the second terminal 26 continuing from the second coil member 12, and the joining portion 18 in the shape of a letter I joining the first and second coil members 10 and 12 are obtained by punching process. Thereafter, by bending the joining portion 18 in a U-shape, the first coil member 10 and the second coil member 12 are overlapped with a predetermined clearance therebetween. This completes the coil winding 2 composed of a conductive plate. The coil winding 2 is not limited to such a bent coil. For example, the coil member and the joining portion may be screwed, welded or fixed with a rivet.

The coil component 1 according to the present embodiment is structured, as shown in FIG. 1, such that both of the second terminals 26 of the two pieces of the coil windings 2 (first coil winding 2A and second coil winding 2B) juxtaposed to each other are connected together via the connecting member 3. In this case, the first coil winding 2A is structured to be wound around a first axis A1 and the second coil winding 2B is structured to be wound around a second axis A2 that is in parallel with the first axis A1. The first axis A1 and the second axis A2 only have to be practically in parallel and, for example, by allowing some tilt by an error in manufacturing and the like, one axis only has to be arranged along the other.

The connecting member 3 is bent, in order to connect both of the second terminals 26 of the first coil winding 2A and the second coil winding 2B together, such that it passes under the first terminal 24 of the second coil winding 2B. When viewed from above the second axis A2 shown in FIG. 1, the connecting member 3 is arranged to spatially cross the first terminal 24 of the second coil winding 2B such that they overlap with each other.

The first coil winding 2A and the second coil winding 2B constituting the coil component 1 are composed of the same member and therefore, when the respective coil windings are viewed in a direction from above to bottom in FIG. 1, winding directions of the coils are the same. As described above, the respective second terminals 26 that are disposed in the same direction (same side) along the first axis A1 and the second axis A2 with respect to the first coil winding 2A and the second coil winding 2B are connected to each other with the connecting member 3. Accordingly, when the first coil winding 2A and the second coil winding 2B juxtaposed to each other are viewed from one end side of the coil (for example, a direction from above to bottom in FIG. 1), the farther terminals of the terminals 24 or 26 of the first coil winding 2A and the second coil winding 2B (or closer terminals when viewed from the bottom towards above) are connected with the connecting member 3. Further, as shown in FIG. 1, in the lined-up direction of the two pieces of the coil windings 2 (2A and 2B) juxtaposed to each other, the first terminal 24 and the second terminal 26 of the first coil winding 2A, and the first terminal 24 and the second terminal 26 of the second coil winding 2B are arranged in this order. The connecting member 3 and the second terminals 26 of the two pieces of the coil windings 2 are fixed together with respective screws 38.

Consequently, the current input to the first terminal 24 of the first coil winding 2A flows through the first coil member 10, the joining portion 18, and the second coil member 12 in this order and up to the second terminal 26 of the first coil winding 2A. Thereafter, via the connecting member 3, the current is fed into the second terminal 26 of the second coil winding 2B. The current then flows through the second coil member 12 of the second coil winding 2B, the joining portion 18, and the first coil member 10 in this order, and is output from the first terminal 24 of the second coil winding 2B. In this case, when the winding direction of the current path in each coil winding is viewed from above towards the bottom in FIG. 1, the winding direction of the first coil winding 2A and the winding direction of the second coil winding 2B differs from each other, and thus the direction of magnetic flux passing through the opening 14 of the first coil winding 2A and the direction of magnetic flux passing through the opening 16 of the second coil winding 2B are opposite to each other. In other words, as the first coil winding 2A and the second coil winding 2B are juxtaposed to each other, there exists a magnetic path that is a path for magnetic flux flowing in a loop through the opening of one of the coils in one direction and through the opening of the other in an opposite direction. Accordingly, the coil component 1 serves as a 4-turn coil.

As shown in FIG. 1, the heat conductive member 5 is installed to the connecting member 3 with a screw 37 such that the connecting member 3 is abutted thereon. The heat conductive member 5 is composed of a material having electrical insulation properties and heat conductivity and, for example, a silicone sheet is suitably used. As described above, since the heat conductive member 5 is composed of a material of electrical insulation properties, the current that flows through the first coil winding 2A, the connecting member 3, and the second coil winding 2B does not flow through the heat conductive member 5. However, as the heat conductive member 5 has heat conductivity, the heat generated by the current flowing through the first coil winding 2A, the connecting member 3, and the second coil winding 2B is conducted to the heat conductive member 5. The screw 37 fixing the heat conductive member 5 protrudes from the heat conductive member 5 on rear side and is also used when mounting the coil component 1 onto a later-described switching power supply unit. Between the screw 37 and the connecting member 3, an insulating member 37*a* is provided so as to avoid the current that flows through the connecting member 3 from flowing into other devices or the like via the screw 37. The insulating member 37*a* is provided so as to cover the inner perimeter edge of a screw hole in the connecting member 3 where the screw 37 is inserted.

Figure 4:
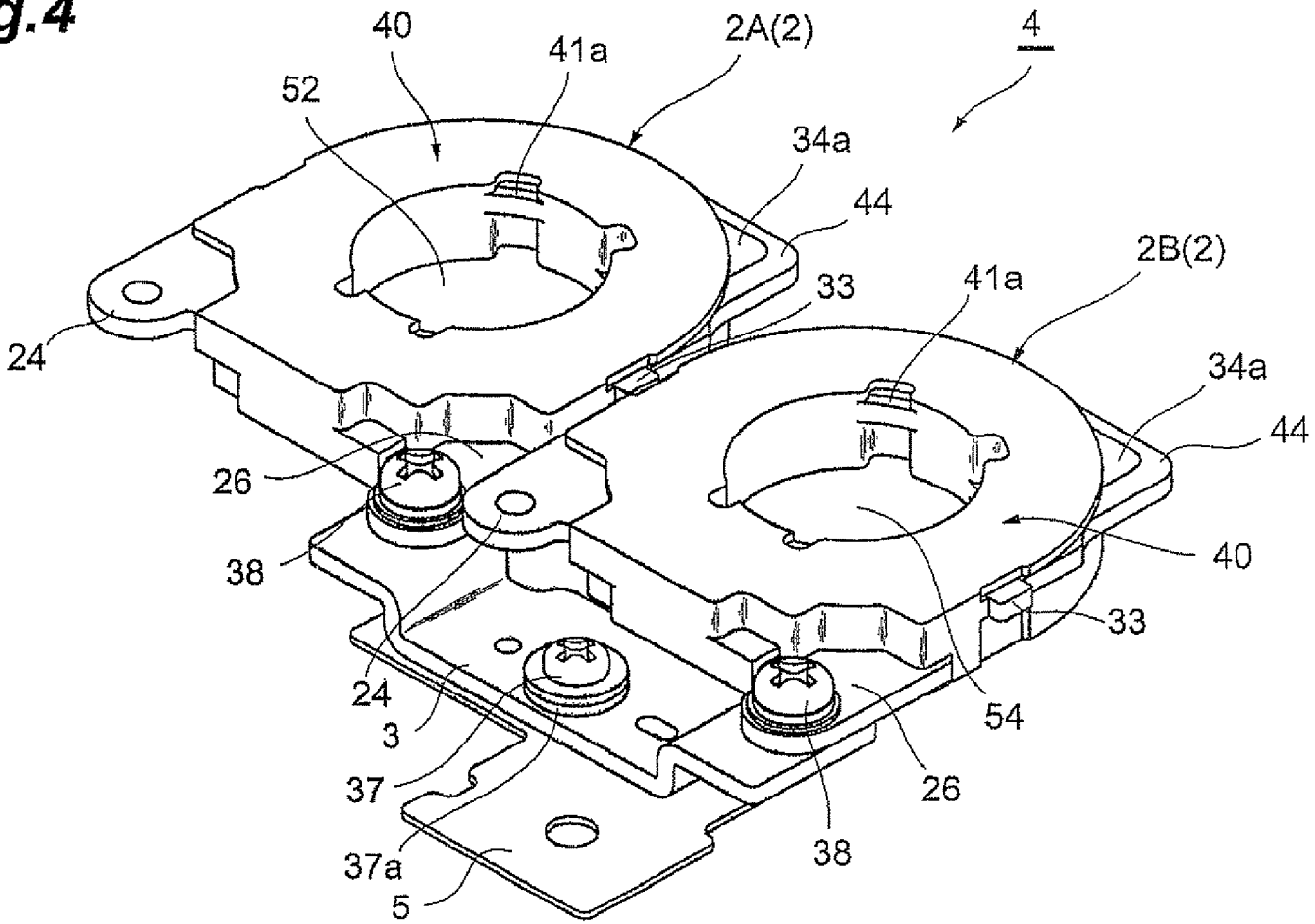
FIG. 4 is a perspective view of a coil component according to another embodiment of the present invention.
Figure 5:
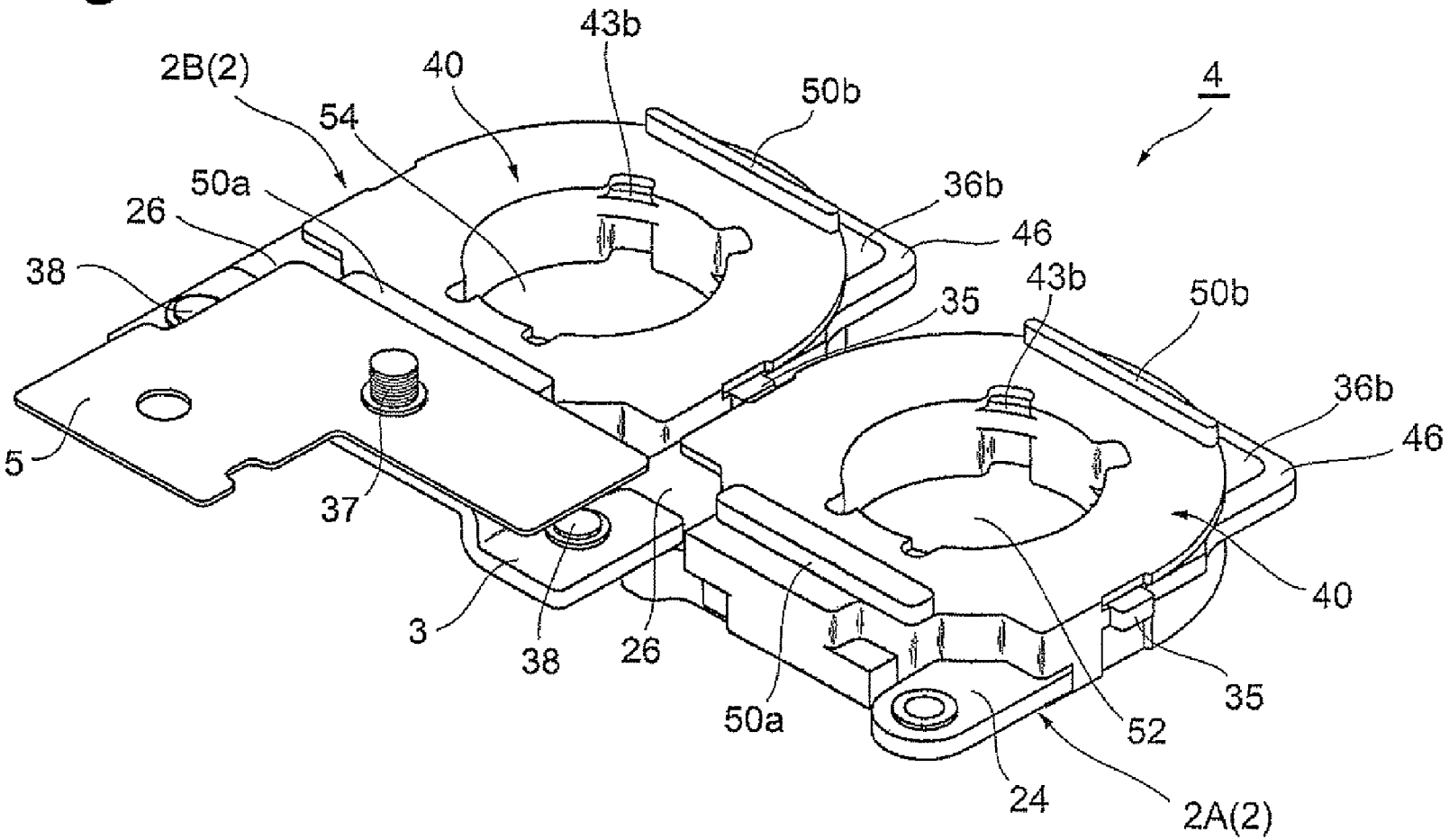
FIG. 5 is a perspective view of the coil component shown in FIG. 4 viewed from the bottom.
Figure 6A:
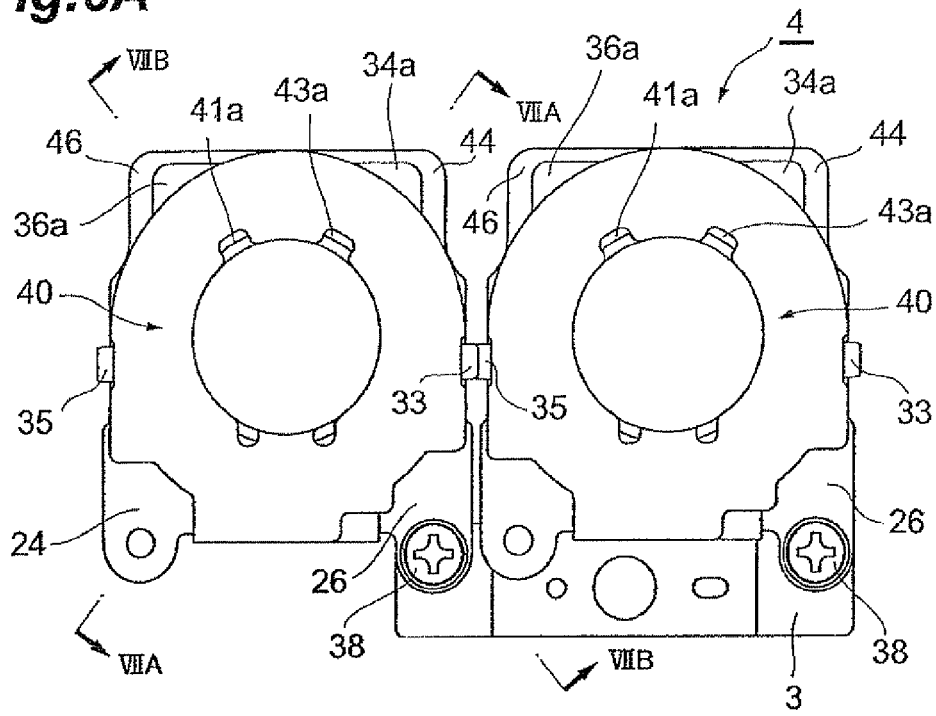
FIG. 6A is a plan view illustrating the configuration of a part of the coil component shown in FIG. 4.
Figure 6B:
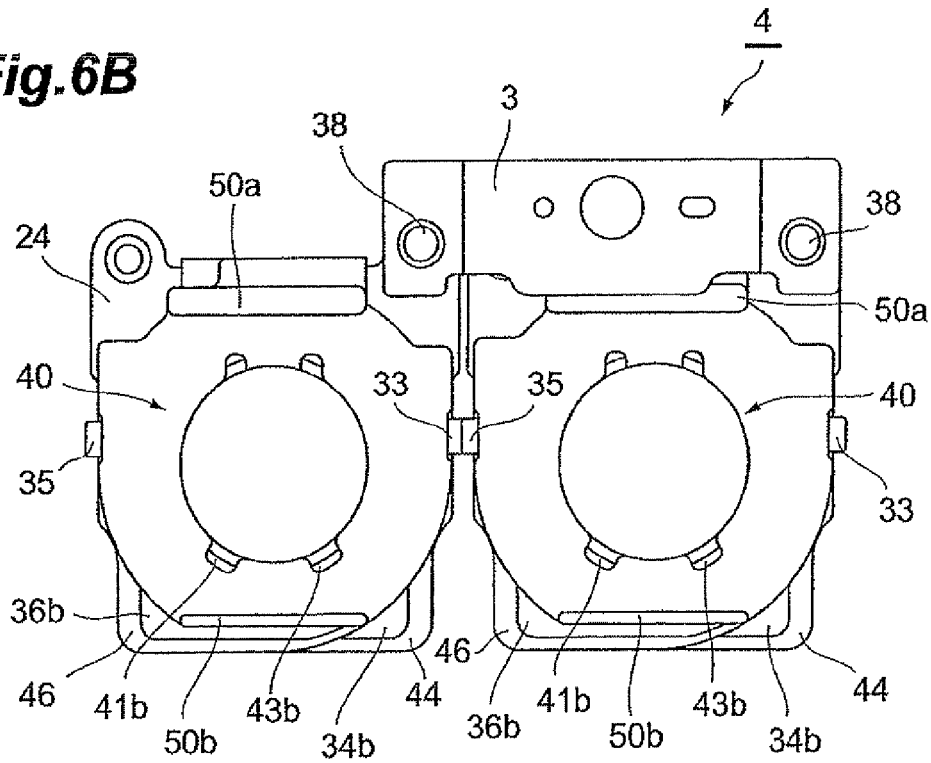
FIG. 6B is a bottom view illustrating the configuration of a part of the coil component.
Figure 7A:
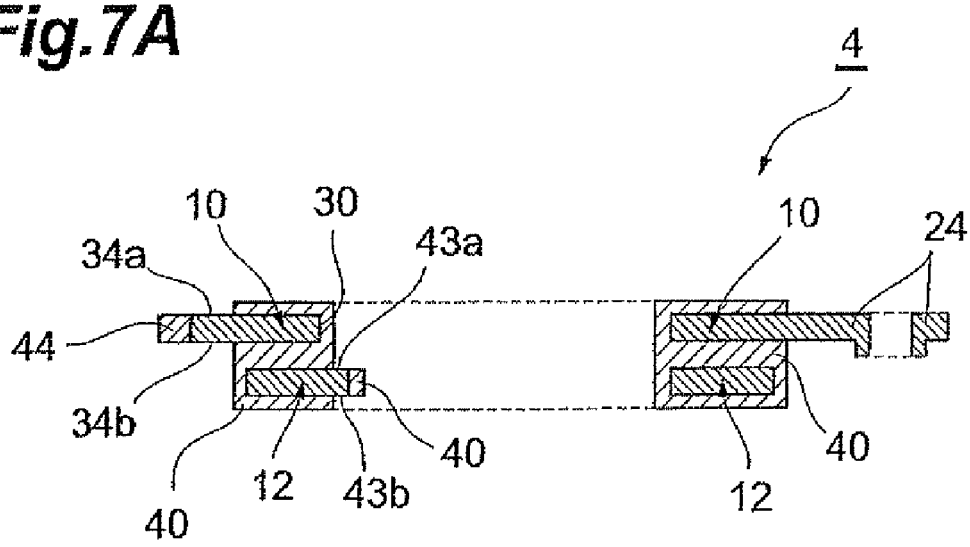
FIG. 7A is a cross-sectional view of the coil component shown in FIG. 6A viewed along the line VII A-VII A.
Figure 7B:
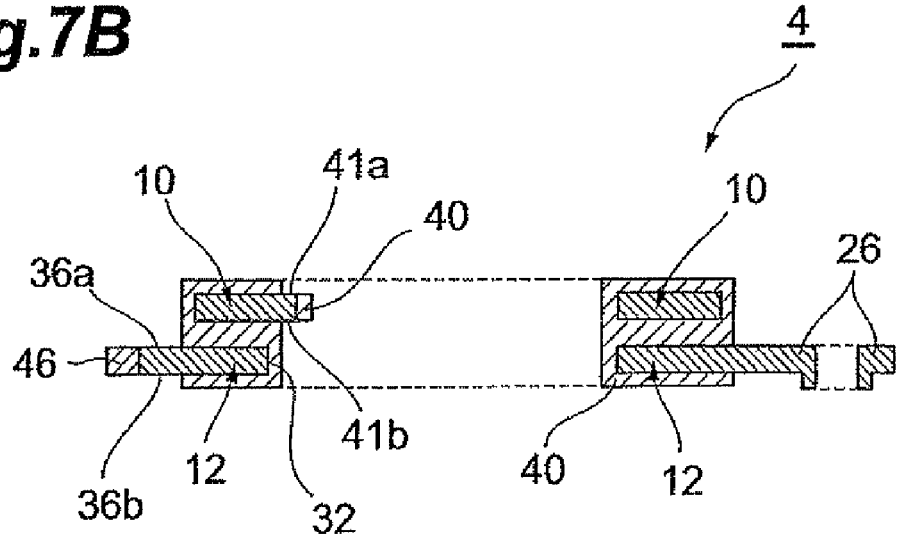
FIG. 7B is a cross-sectional view of the coil component shown in FIG. 6A viewed along the line VII B-VII B.

Next, a coil component according to another embodiment of the present invention will be described with reference to FIGS. 4 to 7. A coil component 4 described below is different from the coil component 1 in that insulating members are integrally formed to the coil windings 2 (2A and 2B). FIG. 4 is a perspective view of the coil component according to the present embodiment. FIG. 5 is a perspective view of the coil component shown in FIG. 4 viewed from the bottom. FIG. 6A is a plan view illustrating the configuration of a part of the coil component shown in FIG. 4, and FIG. 6B is a bottom view illustrating the configuration of a part of the coil component shown in FIG. 4. FIG. 7A is a cross-sectional view of the coil component shown in FIG. 6A viewed along the line VII A-VII A, and FIG. 7B is a cross-sectional view of the coil component shown in FIG. 6A viewed along the line VII B-VII B.

As shown in FIG. 4, the coil component 4 is provided with resin portions 40 composed of an insulating material each covering a part of the areas of the first and second coil members 10 and 12 of the two pieces of the coil windings 2 (2A and 2B). More specifically, the resin portions 40 cover the outermost plate surfaces of the first and second coil members 10 and 12 facing a later-described magnetic core member, a part of the area between the first and second coil members 10 and 12 facing each other, and the inner perimeter edges of the first and second coil members 10 and 12. In the coil component 4 of the present embodiment, the resin portions 40 also cover the outer perimeter edges of the first and second coil members 10 and 12. As for the insulating material used for the resin portions 40, for example, polybutylene terephthalate resin (PBT) and polyphenylene sulfide resin (PPS) are suitably used because they have superior characteristics in heat resistance, chemical resistance, flame resistance, dimensional stability, and the like.

The resin portions 40 cover the surfaces of the first and second coil members 10 and 12 of the two pieces of the coil windings 2 (2A and 2B), except for the first terminals 24 and the second terminals 26. The resin portions 40 also form openings 52 and 54 in the center thereof along the axes of the first and second coil members 10 and 12 of the coil windings 2. In other words, the coil component 4 has hollow sections similar to the coil members 10 and 12. The openings 52 and 54 are provided such that, for example, leg portions of the later-described magnetic core member can be inserted therethrough.

As shown in FIGS. 5 and 6B, on the bottom side of the coil component 4, outwardly protruding convex portions 50*a* and 50*b* formed by the resin portions 40 are provided. They are provided so as to determine the position of the later-described magnetic core member. As shown in FIGS. 7A, 7B and the like, the resin portions 40 are provided to fill the space between the first coil member 10 and the second coil member 12. However, in parts of the surfaces of the protrusions 34 and 36 of the coil windings 2, a part of the area of the second coil member 12 corresponding to the cutout portion 30 of the first coil member 10 along the center axes of the openings 52 and 54, and a part of the area of the first coil member 10 corresponding to the cutout portion 32 of the second coil member 12 along the center axes of the openings 52 and 54, the surfaces of the coil windings 2 are not covered with the resin portions 40 but are exposed to the outside. Now, these exposed areas of the coil windings 2 will be described below.

In the protrusions 34 and 36 of the coil windings 2, the surfaces perpendicular to the center axes of the openings 52 and 54 (i.e., surfaces 34*a*, 34*b*, 36*a* and 36*b* shown in FIGS. 6A and 6B) out of the surfaces thereof are exposed to the outside, while the outer circumferences of the protrusions 34 and 36 are covered with resin portions 44 and 46, respectively. Because of the parts of the areas of the protrusions 34 and 36 being exposed to the outside, for example, by being coupled with a heat conductive member provided to the outside with a member having heat conductivity interposed therebetween in an electrically insulated manner, the heat from the coil windings 2 can be dissipated from the exposed areas. Because of the outer circumferences of the protrusions 34 and 36 being covered with the resin portions 44 and 46, respectively, the insulation of the coil component 4 can be ensured from other devices and the like disposed in its periphery when they contact. As in the present embodiment, since the outer circumferences of the coil windings 2 are covered with the resin portions 40 and the outer circumferences of the protrusions 34 and 36 are covered with the resin portions 44 and 46, respectively, when the coil component 4 is structured with the two pieces of the coil windings 2 covered with the resin portions 40 being juxtaposed to each other, the insulation between the two pieces of the coil windings 2 in the coil component 4 can be ensured.

In the coil component 4 as described above, a part of the area of the second coil member 12 corresponding to the cutout portion 30 of the first coil member 10 along the center axes of the openings 52 and 54 and a part of the area of the first coil member 10 corresponding to the cutout portion 32 of the second coil member 12 along the center axes of the openings 52 and 54 are exposed to the outside. More specifically, as shown in FIGS. 4, 6 and 7, the cutout portion 30 is also covered with the resin portion 40 of the thickness similar to that of other parts of the inner perimeter edge. Accordingly, as shown in FIG. 7A, the area of the second coil member 12 corresponding to the cutout portion 30 of the first coil member 10 along the center axes of the openings 52 and 54 protrudes further inwards of the inner perimeter edge compared to the cutout portion 30 covered with the resin portion 40. The parts of the protruding area that are a front surface 43*a* and a rear surface 43*b* (the area of the second coil member 12 corresponding to the cutout portion 30 of the first coil member 10) are thus exposed to the outside. The insides (inner perimeter portions) of the front surface 43*a* and the rear surface 43*b* exposed to the outside are covered with the resin portion 40, as shown in FIG. 7A, similar to the other portions of the inner perimeters of the first and second coil members 10 and 12. Accordingly, the entire edges of the inner perimeters of the openings 52 and 54 of the coil component 4 are covered with the rein portions 40. Consequently, the insulation can be ensured between the coil windings 2 and the magnetic core member inserted to the openings 52 and 54.

Additionally, the area of the first coil member 10 corresponding to the cutout portion 32 of the second coil member 12 along the center axes of the openings 52 and 54 is formed likewise. More specifically, similar to the area of the second coil member 12 corresponding to the cutout portion 30 of the first coil member 10 described above, as shown in FIG. 7B, the area of the first coil member 10 corresponding to the cutout portion 32 of the second coil member 12 protrudes further inwards of the inner perimeter edge compared to the cutout portion 32. The parts of the protruding area that are a front surface 41*a* and a rear surface 41*b* are exposed to the outside. The insides (inner perimeter portions) of the front surface 41*a* and the rear surface 41*b* exposed to the outside are covered, as shown in FIG. 7B, with the resin portion 40 similar to the other portions of the inner perimeters of the first and second coil members 10 and 12.

In the coil component 4, the protrusions 33 and 35 provided to the first and second coil members 10 and 12 constituting the coil windings 2 are completely exposed to the outside (in other words, even the outer circumferences of the protrusions are not covered with the resin portions 40). As in the case of the protrusions 33 and 35, the outer circumference of the area exposed to the outside without being covered with the resin portions 40 is not necessarily covered with the resin portions 40.

As described in the foregoing, by providing the above-described areas exposed to the outside (the protrusions 33 and 35, the surfaces 34*a*, 34*b*, 36*a* and 36*b* of the protrusions 34 and 36, and the surfaces 41*a*, 41*b*, 43*a*, and 43*b* of the areas corresponding to the cutout portions 30 and 32), compared to the case where those areas are covered with the resin portions 40, the heat of the coil windings 2 can be dissipated to the outside more efficiently.

In the coil component 4, the connecting member 3 is bent towards the bottom of the drawing in FIG. 4 such that it passes under the first terminal 24 of the second coil winding 2B, and the heat conductive member 5 is installed at the position lower than the second terminals 26 of the first and second coil windings 2A and 2B where the connecting member 3 connects. Accordingly, as shown in FIG. 5, so as to extend above the edge portions of the resin portions 40 covering the bottom surfaces of the first and second coil windings 2A and 2B (in other words, so as to lie under the resin portions 40), the heat conductive member 5 of a larger surface area can be mounted on the coil component 4. Consequently, the heat transfer effect of the heat conductive member 5 can be enhanced.

The coil component 4 can be manufactured, for example, by the method described below. First, two pieces of the coil windings 2 in which the first coil member 10 and the second coil member 12 are joined with the joining portion 18 (as the first coil winding 2A and the second coil winding 2B) are prepared. Each of the two pieces of the coil windings 2 is then arranged as an insert component in a mold that is formed in the shape of the resin portion 40 and is molded by injecting resin into the mold to obtain the coil winding 2 in which the parts of the circumferences of the first coil member 10 and the second coil member 12 are integrally formed with the resin portion 40. Then, the two pieces of the coil windings 2 integrally formed with the resin portions 40 are juxtaposed to each other, and the respective second terminals 26 of the coil windings 2 are fixed to the electrically conductive connecting member 3 with the screws 38, and then the heat conductive member 5 is fixed to the connecting member 3 with the screw 37 to complete the coil component 4. The heat conductive member 5 may not be fixed with the screw 37. For example, by providing an opening having a diameter substantially larger than the diameter of the screw 37 to the heat conductive member 5, when fixing the coil component 4 to the later-described switching power supply unit or the like using the screw 37, the heat conductive member 5 may be provided to be sandwiched between the coil component 4 and the switching power supply unit such that the heat conductive member 5 comes in contact with the coil component 4. When the heat conductive member 5 is composed of a material having adhesion, for example, the heat conductive member 5 may be provided to contact the connecting member 3 by being tightly adhered to the connecting member 3.

In addition, by the molding pressure in molding (i.e., the pressure when injecting resin into the mold), the coil winding 2 may sometimes be deformed and a short-circuiting may occur. However, even though the coil winding 2 is deformed while molding, it is difficult to check if a short-circuiting exists in the coil winding 2 after being integrally molded. For this reason, when integrally forming the coil component 4 with the resin portion 40, for the purpose of preventing the coil winding 2 from deforming by the molding pressure, the protrusions 34 and 36 provided to the first and second coil members 10 and 12, a part of the area of the second coil member 12 corresponding to the cutout portion 30 of the first coil member 10 along the center axes of the openings 52 and 54, and a part of the area of the first coil member 10 corresponding to the cutout portion 32 of the second coil member 12 along the center axes of the openings 52 and 54 can be mechanically secured by the mold. Accordingly, the deformation of the coil winding 2 in molding can be prevented. The areas mechanically secured are not covered with resin and become the areas exposed to the outside (more specifically, the surfaces 34*a*, 34*b*, 36*a* and 36*b* of the protrusions 34 and 36 and the surfaces 41*a*, 41*b*, 43*a* and 43*b* that are the areas corresponding to the cutout portions 30 and 32).

Figure 8:
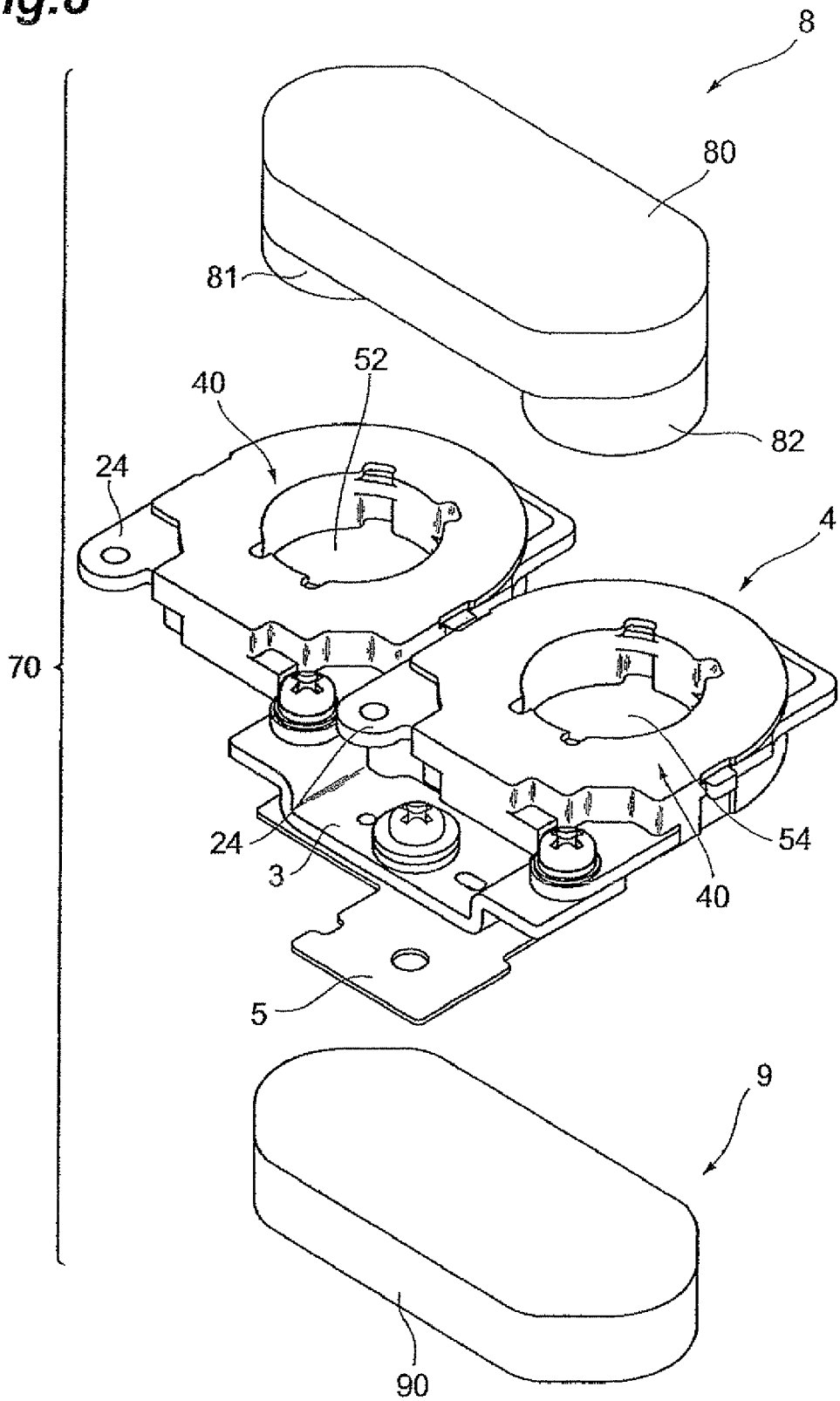
FIG. 8 is an exploded perspective view of a coil component further provided with magnetic core members.

The coil components 1 and can further be made into a coil component 70 provided with a magnetic core member. The coil component 70 serves as, for example, a choke coil of the later described switching power supply unit. Now, an alternative embodiment of the coil component 70 further provided with the magnetic core member to the coil component 4 will be described below. FIG. 8 is an exploded perspective view of the coil component 70 according to the present embodiment.

As shown in FIG. 8, the coil component 70 is provided with the coil component 4 in which the surfaces of the coil windings 2 (2A and 2B) are covered with the rein portions 40, and a pair of magnetic core members 8 and 9. As shown in FIG. 8, the magnetic core members 8 and 9 are disposed so as to sandwich the coil component 4 along the center axes of the openings 52 and 54 of the coil component 4. The openings 52 and 54 are the through holes for the leg portions of the magnetic core members 8 and 9 to pass through. The coil component 70 is structured such that, under the condition of being sandwiched by the pair of magnetic core members 8 and 9, the first and second terminals 24 and 26 and the connecting member 3 coupled with the heat conductive member 5 protrude from the magnetic core members 8 and 9.

The magnetic core members 8 and 9 are of so-called U-shaped core and I-shaped core, respectively, obtainable by powder compacting ferrite powders. More specifically, the magnetic core member 8 is composed of a flat plate-like base 80 having a longitudinal direction, and two pieces of cylindrical leg portions 81 and 82 protruding from one of the principal surfaces of the base 80, and the leg portion 81 and the leg portion 82 are coupled with the base 80 and spaced apart therefrom. Meanwhile, the magnetic core member 9 is composed of a flat plate-like base 90 having a longitudinal direction.

The leg portions 81 and 82 of the magnetic core member 8 are inserted into and through the openings 52 and 54, respectively, of the coil component 4. The leg portions 81 and 82 inserted to the openings 52 and 54 abut on the base 90 of the magnetic core member 9.

One of the principal surfaces of the base 80 of the magnetic core member 8 abuts on the resin portions 40 on one of the principal surfaces (upper surface shown in FIG. 4) of the coil component 4. One of the principal surfaces of the base 90 of the magnetic core member 9 abuts on the resin portions 40 on the other of the principal surfaces of the coil component 1 (bottom surface shown in FIG. 5). In this case, by the convex portions 50*a* and 50*b* provided to the resin portions 40 abutting on two facing sides of the base 90 in the longitudinal direction, the positional displacement between the magnetic core member 9 and the coil component 4 in a width direction thereof can be suppressed. Additionally, while the convex portions 50*a* and 50*b* provided to the resin portions 40 of the coil component 4 are formed in rib shapes along the outer circumference of the base 90 in the longitudinal direction, the shapes of the convex portions are not limited as such. For example, a number of convex portions may be provided along the outer circumference of the base 90 including in a widthwise direction or, by providing concave portions to the base 90 and by providing the convex portions to the resin portion 40 at the positions corresponding to the concave portions, the abutting positions of the coil component 4 and the magnetic core member 9 may be determined.

In the coil component 70 thus structured as described above, when a current is input to the first terminal 24 of the first coil winding 2A and output from the first terminal 24 of the second coil winding 2B, since the first coil winding 2A and the second coil winding 2B are wound such that the direction of magnetic flux generated inside the leg portion 81 passing through the center of the first coil winding 2A (first direction) and the direction of magnetic flux generated inside the leg portion 82 passing through the center of the second coil winding 2B (second direction) are to be different, by the current flowing through the first and second coil windings 2A and 2B, a magnetic path passing in a loop through the insides of the leg portions 81 and 82 and the inside of the base 90 is formed. Accordingly, the coil component 70 serves as a 4-turn coil. The coil component 70 has advantages of, by having the structure described above, for example, compared to the case where a 4-turn coil is provided by stacking coils in one direction, its height being reduced with advantageous heat dissipation. Further, for example, compared to the case where two pieces of 2-turn coils are connected in the shape of a number 8 (glasses-like winding), the connecting member 3 and the heat conductive member 5 mounted on the connecting member 3 provide an advantageous heat dissipation effect.

Figure 9:
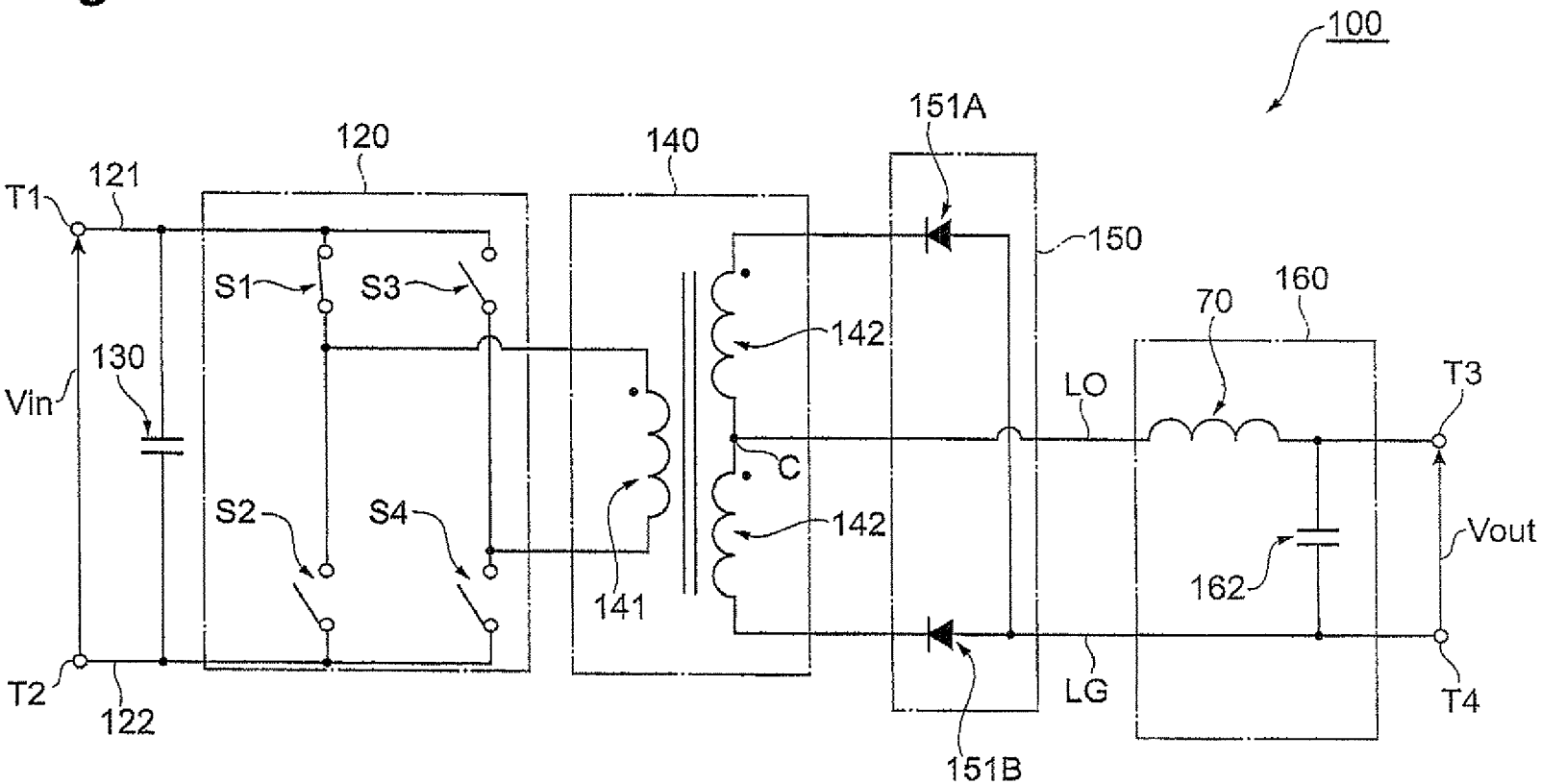
FIG. 9 is a schematic circuit diagram of a switching power supply unit according to an embodiment of the present invention.
Figure 10:
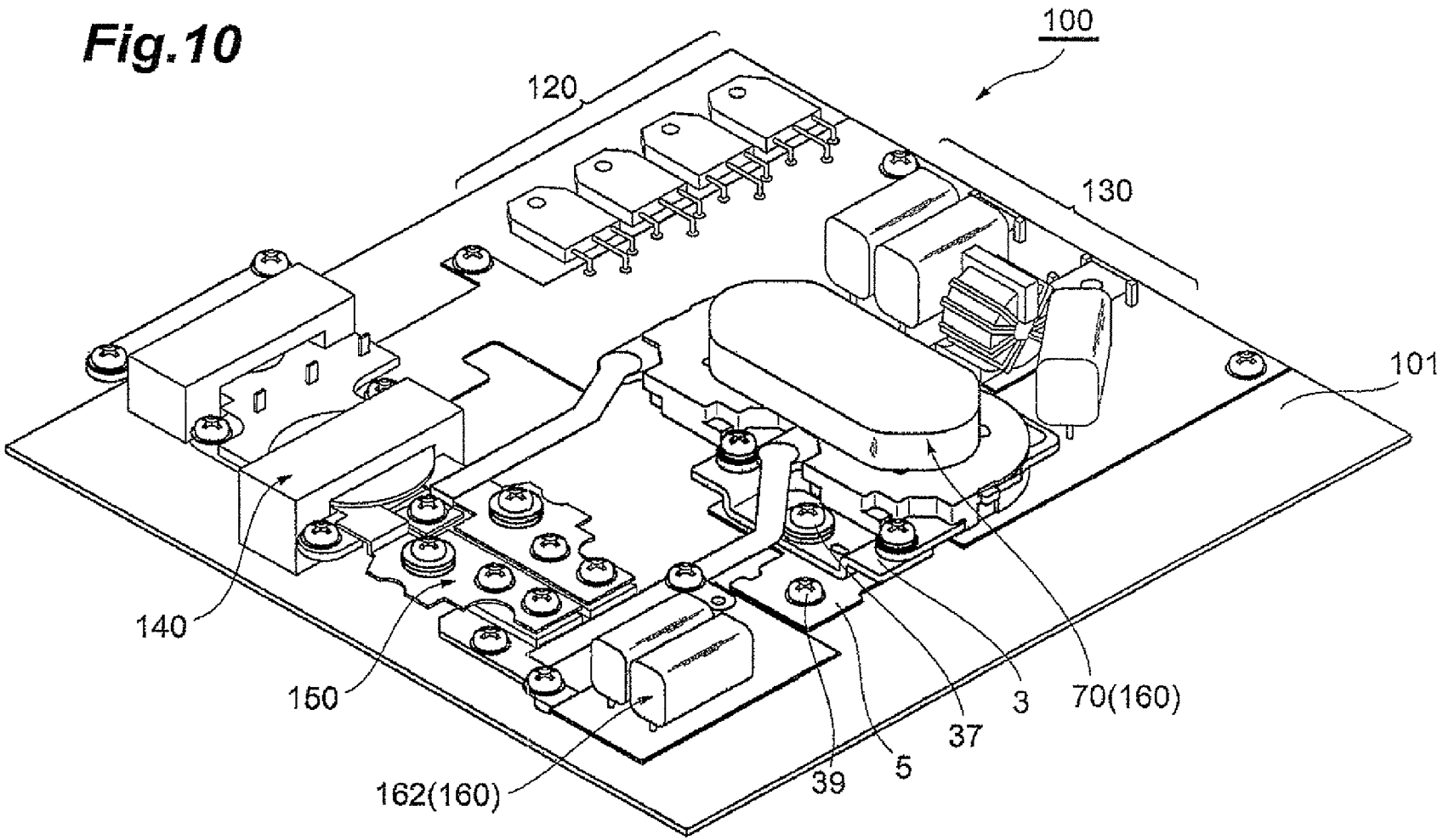
FIG. 10 is a perspective view of the switching power supply unit according to the embodiment.

Next, a switching power supply unit in which the above-described coil component 70 is suitably used will be described below. FIG. 9 is a schematic circuit diagram of a switching power supply unit 100. FIG. 10 is a perspective view of the switching power supply unit 100. The switching power supply unit 100 according to the present embodiment serves as a DC-DC converter and, for example, converts a high DC input voltage Vin that is supplied from a high voltage battery storing a voltage of about 100 to 500 V to a low DC output voltage Vout, and supplies it to a low voltage battery storing a voltage of about 12 to 16 V.

The switching power supply unit 100, as shown in FIG. 10, has a base plate 101 that is a part of a chassis of the switching power supply unit 100 and, on the base plate 101, an input smoothing capacitor (input filter) 130, a switching circuit 120, a main transformer 140, a rectifier circuit 150, and a smoothing circuit 160 composed of a choke coil (coil component) 70 and an output smoothing capacitor 162 are mounted. The base plate 101 on its back surface is to be cooled, for example, by air-cooling or water-cooling. In other words, the base plate 101 has a function as a heat sink.

The switching power supply unit 100 is provided with, more specifically, the switching circuit 120 and the smoothing capacitor 130 being provided between a primary high voltage line 121 and a primary low voltage line 122, the main transformer 140 having primary and secondary transformer coil sections 141 and 142, the rectifier circuit 150 connected to the secondary transformer coil section 142, and the smoothing circuit 160 connected to the rectifier circuit 150.

The switching circuit 120 is configured as a full bridge type circuit composed of switching elements S1 to S4. The switching circuit 120 converts, for example, in response to a driving signal provided from a drive circuit (not shown), the DC input voltage Vin applied between input terminals T1 and T2 into an AC input voltage.

The input smoothing capacitor 130 smoothes out the DC input voltage Vin input from the input terminals T1 and T2. The main transformer 140 transforms the AC input voltage produced by the switching circuit 120 and outputs an AC output voltage. The turn ratio of the primary and secondary transformer coil sections 141 and 142 is appropriately set according to the ratio of transformation. Here, the number of turns for the primary transformer coil section 141 is made larger than the number of turns for the secondary transformer coil section 142. The secondary transformer coil section 142 is of a center-tap type and is connected to an output terminal T3 via a connecting terminal C and an output line LO.

The rectifier circuit 150 is of a single-phase full-wave rectification type composed of rectifier diodes 151A and 151B. A cathode of each of the rectifier diodes 151A and 151B is connected to the secondary transformer coil section 142, while an anode thereof is connected to a ground line LG leading to an output terminal T4. Accordingly, the rectifier circuit 150 individually rectifies the AC output voltage output from the main transformer 140 during each half-wave period and produces a DC voltage.

The smoothing circuit 160 is structured to include the choke coil (coil component) 70 and the output smoothing capacitor 162. The choke coil 70 is inserted in the output line LO. The output smoothing capacitor 162 is connected on the output line LO between the choke coil 70 and the ground line LG. Accordingly, the smoothing circuit 160 smoothes out a DC voltage rectified by the rectifier circuit 150 to produce the DC output voltage Vout and provides the DC output voltage Vout from the output terminals T3 and T4 to a low voltage battery and the like.

As shown in FIG. 10, when mounting the choke coil (coil component) 70 onto the base plate 101 of the switching power supply knit 100, the heat conductive member 5 included in the coil component 70 is secured with the screw 37 and the screw 39 so as to contact the base plate 101. Accordingly, the connecting member 3 included in the choke coil 70 and electrically connecting the first coil winding 2A and the second coil winding 2B together is coupled, with the screw 37, to the base plate 101 (chassis of the switching power supply unit 100) with the heat conductive member 5 interposed therebetween. Consequently, the heat generated in the first coil winding 2A and the second coil winding 2B when current flows through the choke coil 70 is conducted, via the connecting member 3 and the heat conductive member 5, to the base plate 101 that serves as a heat sink. Consequently, compared to the case where the connecting member 3 is not coupled with the base plate 101, the heat dissipation of the heat generated in the coil windings 2 (2A and 2B) can further be enhanced.

In the switching power supply unit 100 thus structured, the DC input voltage Vin supplied from the input terminals T1 and T2 is switched to produce an AC input voltage, and the AC input voltage produced is supplied to the primary transformer coil section 141 of the main transformer 140. The AC input voltage produced is transformed and is output from the secondary transformer coil section 142 as an AC output voltage. Then, the AC output voltage is rectified by the rectifier circuit 150 and smoothed by the smoothing circuit 160, and then output from the output terminals T3 and T4 as the DC output voltage Vout. The application of the coil component 4 in the switching power supply unit 100 is not limited to the choke coil 70 as illustrated in the above embodiment. The coil component 4 can be suitably applied to the main transformer 140.

As described in the foregoing, the coil component 4 according to the present embodiment, the connecting member 3 for electrically connecting the first coil winding 2A and the second coil winding 2B together is coupled with the heat conductive member 5 having electrical insulation properties and heat conductivity, whereby the heat generated in the first coil winding 2A and the second coil winding 2B is efficiently dissipated from the heat conductive member 5.

As in the coil component 4, by covering the circumferences and the inner perimeter edges of the first coil winding 2A and the second coil winding 2B with the resin portions 40, the insulation of the coil windings 2 from the magnetic core members 8 and 9 sandwiching the coil component 4 and the insulation between the adjacent coil members 10 and 12 are achieved. In addition, when the circumferences of the first coil winding 2A and the second coil winding 2B are covered with the resin portions 40 as the coil component 4, the heat dissipation from the surfaces of the first coil winding 2A and the second coil winding 2B is limited. Accordingly, compared to the case where the heat conductive member 5 is not provided, the heat dissipation effect is more pronounced by coupling the connecting member 3 with the heat conductive member 5 as illustrated in the present embodiment.

By using the coil component 4 in the switching power supply unit 100, as the heat generated in the first and second coil windings 2A and 2B is conducted to the base plate 101 constituting the chassis of the switching power supply unit 100 via the connecting member 3 and the heat conductive member 5, the heat can be dissipated more efficiently. Similarly, when the coil component 4 is applied to the main transformer 140, a transformer using the coil component 4 that can efficiently dissipate the heat from the coil windings 2 can be obtained.

While embodiments of the present invention have been described above, the present invention is not limited to the above embodiments and various modifications and alterations can be made.

For example, as the coil component 4 in the embodiments above, it is described that, by covering the surfaces of the two pieces of the coil windings 2 (2A and 2B) juxtaposed to each other with the rein portions 40, the insulation of the outermost plate surfaces of the coil members (first and second coil members 10 and 12) facing the magnetic core members, the insulation of the area between the adjacent first and second coil members 10 and 12, and the insulation of the inner perimeter edges of the first and second coil members 10 and 12 are achieved. However, the insulation may be achieved not only by the covering of the resin portions 40. For example, for the coil component 1, a component such as a bobbin may be installed such that the insulation of the above-described areas is to be achieved.

While it is described that the first coil winding 2A and the second coil winding 2B are structured with the members of the same form (coil winding 2), they may be in different forms from each other. The number of turns may be different between the first coil winding 2A and the second coil winding 2B. More specifically, the number of coil members for each of the coil windings 2 (2A and 2B) only has to be one or more. While it is described that the second terminals 26 of the first coil winding 2A and the second coil winding 2B are connected together with the connecting member 3 and, the screws 38, the connecting member 3 and the coil windings 2 (2A and 2B) may be fixed together, for example, with rivets. In addition, the connecting member 3 may be connected to the one side or both sides of the coil windings 2 (2A and 2B) by welding. Furthermore, the connecting member 3 may be formed integrally with either one of the coil windings 2 (2A and 2B), for example, by punching process.

In the embodiments described above, while it is described that the first coil winding 2A and the second coil winding 2B are juxtaposed to each other on a flat plane, the first coil winding 2A and the second coil winding 2B may be juxtaposed to each other, for example, at different levels. In this case, the connecting member 3 for connecting the terminals of the first coil winding 2A and the second coil winding 2B together can be used with an appropriate modification applied to the above embodiments.

In the coil component 1, while it is described that the heat conductive member 5 is coupled with the connecting member 3, the heat conductive member 5 of the coil component 1 may further be provided at a position different from the connecting member 3. For example, a heat conductive member may be mounted on the portions of the coil windings 2 (2A and 2B) exposed to the outside.

The positions of the protrusions 34 and 36 provided to the first coil member 10 and the second coil member 12 may appropriately be changed. The number of the protrusions 34 and 36 may also be changed.

In the above embodiments, it is described that the outer circumferences of the protrusions 34 and 36 are covered with the resin portions 44 and 46, while the parts of the surfaces of the protrusions 34 and 36 are exposed. The rein portions 44 and 46 are provided to maintain insulation when they contact other devices or the like and are not essential. In other words, the exposed parts are not limited to the parts of the surfaces of the protrusions 34 and 36, and their entire surfaces may be exposed as in the protrusions 33 and 35.

The form of the pair of magnetic core members 8 and 9 is not limited to a so-called UI-type where one of the magnetic core members, i.e. magnetic core member 8, has leg portions 81 and 82 as illustrated in the above embodiment. For example, a so-called UU-type where both of the magnetic core members 8 and 9 have leg portions may be used, or an air-core configuration without having leg portions 81 and 82 may also be used.

The configuration of the switching power supply unit is not limited to the one illustrated in FIGS. 9 and 10. In other words, the coil component 1 according to the present embodiment is suitably applied to, for example, an inverter.

What is claimed is:

1. A coil component comprising:

a first coil winding formed by joining a plurality of plate-like coil members in a ring shape having ends wound around a first axis and having a portion defining an opening in center thereof;

a second coil winding formed of members of a same form as the first coil winding wound around a second axis running along the first axis, juxtaposed to the first coil winding, and having a portion defining an opening in center thereof;

a connecting member configured to electrically connect together an end of the first coil winding to an end of the second coil winding, the connected ends of the first and second coil windings being disposed in a same direction along an extending axis of the first axis and the second axis with respect to the first coil winding and the second coil winding; and a heat conductive member having electrical insulation properties and provided to contact the connecting member, wherein the first coil winding and the second coil winding are each wound such that magnetic flux is generated by a current flowing through the first coil winding and the second coil winding to pass through the opening of the first coil winding in one direction and through the opening of the second coil winding in an opposite direction to the direction passing through the opening of the first coil winding, on an inner perimeter edge of the coil members, a cutout portion where a portion of the coil members is outwardly cut is formed, and in an area of an outer perimeter edge of the coil members that are an extension of a line connecting a center axis of the opening and the cutout portion, a protrusion where a portion of the coil members are outwardly bulged is provided such that the outer perimeter edge of the coil members becomes larger in a radial direction.

2. The coil component according to claim 1, further comprising a pair of magnetic core members sandwiching the first coil winding and the second coil winding.

3. A transformer comprising a coil component, the coil component comprising:

a first coil winding formed by joining a plurality of plate-like coil members in a ring shape having ends wound around a first axis and having a portion defining an opening in center thereof;

a second coil winding formed of members of a same form as the first coil winding wound around a second axis running along the first axis, juxtaposed to the first coil winding, and having a portion defining an opening in center thereof;

a connecting member configured to electrically connect together an end of the first coil winding to an end of the second coil winding, the connected ends of the first and second coil windings being disposed in a same direction along an extending axis of the first axis and the second axis with respect to the first coil winding and the second coil winding; and a heat conductive member having electrical insulation properties and provided to contact the connecting member, wherein the first coil winding and the second coil winding are each wound such that magnetic flux is generated by a current flowing through the first coil winding and the second coil winding to pass through the opening of the first coil winding in one direction and through the opening of the second coil winding in an opposite direction to the direction passing through the opening of the first coil winding, on an inner perimeter edge of the coil members, a cutout portion where a portion of the coil members is outwardly cut is formed, and in an area of an outer perimeter edge of the coil members that are an extension of a line connecting a center axis of the opening and the cutout portion, a protrusion where a portion of the coil members are outwardly bulged is provided such that the outer perimeter edge of the coil members becomes larger in a radial direction.

4. A switching power supply unit comprising a coil component, the coil component comprising:

a first coil winding formed by joining a plurality of plate-like coil members in a ring shape having ends wound around a first axis and having a portion defining an opening in center thereof;

a second coil winding formed of members of a same form as the first coil winding wound around a second axis running along the first axis, juxtaposed to the first coil winding, and having a portion defining an opening in center thereof;

a connecting member configured to electrically connect together an end of the first coil winding to an end of the second coil winding, the connected ends of the first and second coil windings being disposed in a same direction along an extending axis of the first axis and the second axis with respect to the first coil winding and the second coil winding; and a heat conductive member having electrical insulation properties and provided to contact the connecting member, wherein the first coil winding and the second coil winding are each wound such that magnetic flux is generated by a current flowing through the first coil winding and the second coil winding to pass through the opening of the first coil winding in one direction and through the opening of the second coil winding in an opposite direction to the direction passing through the opening of the first coil winding, on an inner perimeter edge of the coil members, a cutout portion where a portion of the coil members is outwardly cut is formed, and in an area of a outer perimeter edge of the coil members that are an extension of a line connecting a center axis of the opening and the cutout portion, a protrusion where a portion of the coil members are outwardly bulged is provided such that the outer perimeter edge of the coil members becomes larger in a radial direction.

5. The switching power supply unit according to claim 4, wherein the connecting member is coupled with a chassis of the switching power supply unit via the heat conductive member contacting therewith.

* * * * *